US006910872B2

(12) United States Patent
Cho et al.

(10) Patent No.: US 6,910,872 B2
(45) Date of Patent: Jun. 28, 2005

(54) ROTARY COMPRESSOR

(75) Inventors: Sung-Hea Cho, Suwon (KR); Sung-Yeon Park, Seongnam (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 0 days.

(21) Appl. No.: 10/310,821

(22) Filed: Dec. 6, 2002

(65) Prior Publication Data

US 2003/0223900 A1 Dec. 4, 2003

(30) Foreign Application Priority Data

May 29, 2002 (KR) ..... 2002-29929

(51) Int. Cl.[7] ..... F03C 2/00
(52) U.S. Cl. ..... 418/60; 418/69; 192/45
(58) Field of Search ..... 418/60, 69; 192/48.92, 192/45

(56) References Cited

U.S. PATENT DOCUMENTS 2,926,765 A * 3/1960 Heid ..... 192/48.4
4,485,699 A * 12/1984 Fuller ..... 192/48.92
4,561,827 A * 12/1985 Beaumont ..... 417/223
4,989,705 A * 2/1991 Kashio et al. ..... 192/45
5,211,274 A * 5/1993 Milano et al. ..... 192/45
5,529,159 A * 6/1996 Troccaz ..... 192/45

FOREIGN PATENT DOCUMENTS

JP 59063392 A * 4/1984 ..... F04C/23/00
JP 59063393 A * 4/1984 ..... F04C/23/00
JP 59147895 A * 8/1984 ..... F04C/23/00
JP 60125792 A * 7/1985 ..... F04C/23/00
JP 63057889 A * 3/1988 ..... F04C/29/10
JP 04081590 A * 3/1992 ..... F04C/18/18
JP 7-189956 7/1995
JP 2001-73977 3/2001
KR 2000-21810 4/2000

* cited by examiner

*Primary Examiner*—Theresa Trieu
(74) *Attorney, Agent, or Firm*—Staas & Halsey LLP

(57) ABSTRACT

A variable rotary compressor with a capacity being variable as desired includes a drive device generating a rotating force, a rotating shaft connected to the drive device at a first end thereof and rotated by the drive device, and a cylinder through which a second end of the rotating shaft passes. Two or more compressing chambers are provided in the cylinder such that the two or more compressing chambers are sequentially arranged along an axial direction of the rotating shaft. Rollers are eccentrically installed on the rotating shaft such that the rollers are arranged, respectively, in the two or more compressing chambers. A one-way clutch is installed on the rotating shaft to selectively transmit the rotating force to at least one of the rollers in accordance with a rotating direction of the rotating shaft. During operation of the rotary compressor, only one of the rollers is selectively rotated.

17 Claims, 4 Drawing Sheets

ROTARY COMPRESSOR

CROSS-REFERENCE TO RELATED APPLICATIONS

This application claims the benefit of Korean Patent Application No. 2002-29929 filed on May 29, 2002, in the Korean Intellectual Property Office, the disclosure of which is incorporated herein by reference.

BACKGROUND OF THE INVENTION

1. Field of the Invention

The present invention relates, in general, to rotary compressors for refrigeration cycles and, more particularly, to a rotary compressor, a capacity of which is variable as desired.

2. Description of the Related Art

As is well known to those skilled in the art, rotary compressors have been preferably and widely used as compressors for a variety of refrigeration systems, such as air conditioners or refrigerators operated with refrigerant sequentially and repeatedly flowing through a refrigeration cycle including compression-condensation-expansion-evaporation. In the refrigeration system, the compressor compresses the refrigerant to highly pressurize the refrigerant prior to discharging the highly pressurized refrigerant to a condenser.

As shown in FIG. 1, a conventional rotary compressor for refrigeration systems comprises a hermetic casing 1 with a drive device 2 and a compressing device 3 installed in the hermetic casing 1. The drive device 2 generates a rotating force, and the compressing device 3 compresses the refrigerant using the rotating force of the drive device 2. A rotating shaft 4 is axially arranged in the hermetic casing 1 such that the rotating shaft 4 is rotated by the rotating force of the drive device 2 and transmits the rotating force to the compressing device 3.

The compressing device 3 comprises variable compressing chambers 5 and a roller 6 rotatably set in a bore of the compressing device 3 to define the variable compressing chambers 5 in said bore. The roller 6 of the compressing device 3 is rotated in the bore by the rotating force of the rotating shaft 4, thus compressing the refrigerant in the chambers 5.

However, the conventional rotary compressors are fixed in capacities thereof, so to change a capacity of the conventional rotary compressor after the conventional rotary compressor is completely assembled is impossible. Therefore, the conventional rotary compressor cannot meet a change in a refrigerating load of refrigeration cycles during a use of the conventional rotary compressor, thus causing the refrigeration systems to sometimes excessively consume electric energy.

SUMMARY OF THE INVENTION

Accordingly, a rotary compressor is provided, of which a capacity is variable as desired.

Additional aspects and advantages of the invention will be set forth in part in the description which follows and, in part, will be obvious from the description, or may be learned by practice of the invention.

In order to accomplish the above and other aspects, a rotary compressor is provided, comprising a drive device generating a rotating force, a rotating shaft connected to the drive device at a first end thereof and rotated by the rotating force of the drive device, and a cylinder through which a second end of the rotating shaft passes, wherein two or more compressing chambers are provided in the cylinder such that the two or more compressing chambers are sequentially arranged along an axial direction of the rotating shaft; a plurality of rollers are eccentrically installed on the rotating shaft such that the rollers are arranged in the compressing chambers, respectively; and a clutch is installed on the rotating shaft to transmit the rotating force of the rotating shaft to at least one of the rollers.

In the rotary compressor, the clutch may be a one-way clutch transmitting the rotating force of the rotating shaft to a selected roller only when the rotating shaft is rotated in a predetermined rotating direction.

In the rotary compressor, the compressing chambers comprise first and second compressing chambers, the rollers comprise first and second rollers set in the first and second compressing chambers, respectively; and the one-way clutch is installed inside at least one of the first and second rollers.

The first roller is provided with a first one-way clutch which exclusively transmits the rotating force of the rotating shaft to the first roller only when the rotating shaft is rotated in a first rotating direction, while the second roller is provided with a second one-way clutch which exclusively transmits the rotating force of the rotating shaft to the second roller only when the rotating shaft is rotated in a second rotating direction.

The one-way clutch is a one-way roller clutch comprising: a cylindrical clutch body; a plurality of roller-seating grooves formed on an inner surface of the cylindrical clutch body such that each of the roller-seating grooves is gradually deeper in a direction toward an outer circumferential surface of the cylindrical clutch body; and a roller bearing is seated in each of the roller-seating grooves.

BRIEF DESCRIPTION OF THE DRAWINGS

These and other aspects and advantages of the present invention will become apparent and more readily appreciated from the following description of the embodiments, taken in conjunction with the accompanying drawings of which.

DETAILED DESCRIPTION OF THE PREFERRED EMBODIMENTS

Figure 1:
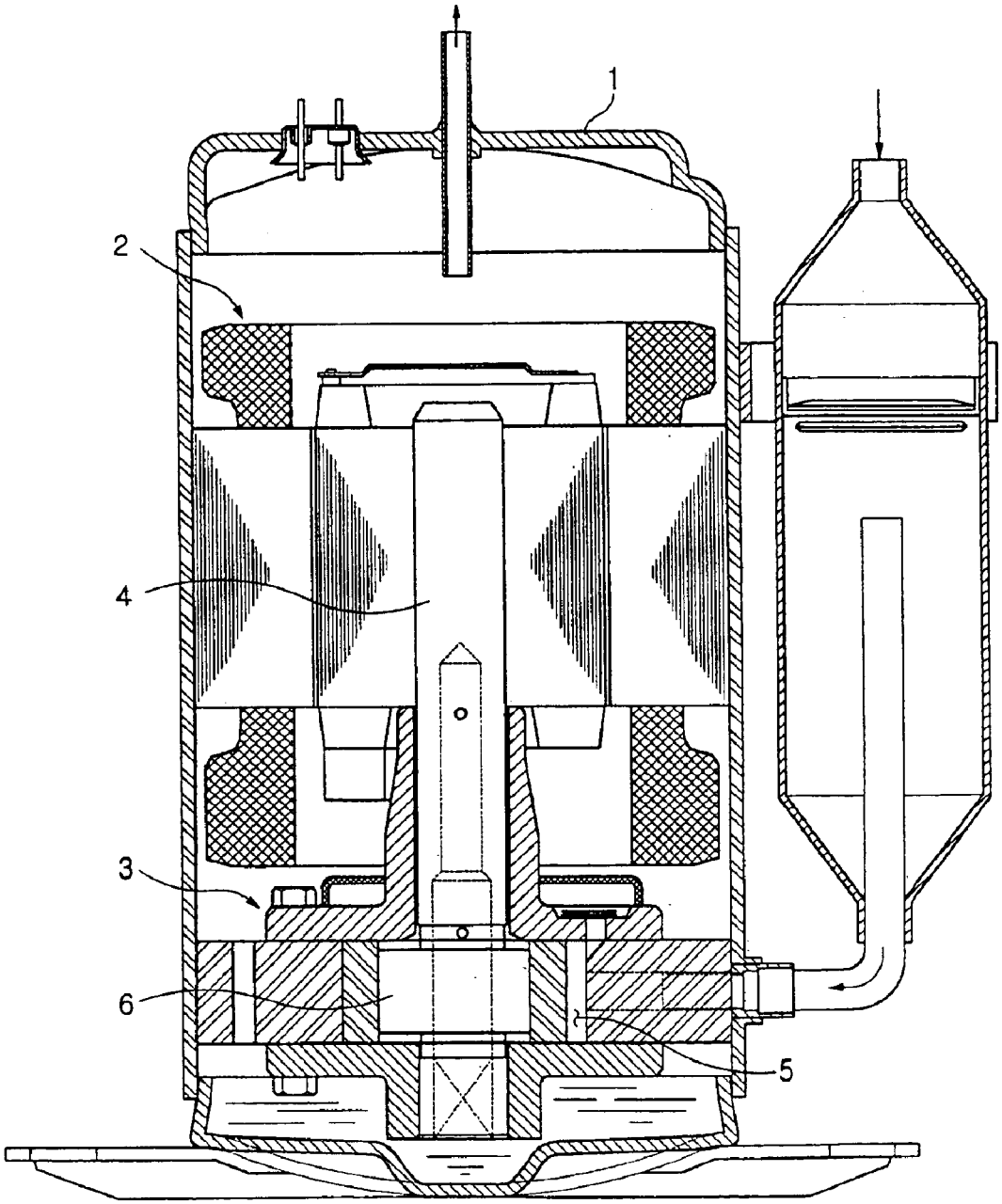
FIG. 1 (PRIOR ART)
FIG. 1 is a sectional view of a conventional rotary compressor.

Reference will now be made in detail to the present preferred embodiments of the present invention, examples of which are illustrated in the accompanying drawings, wherein like reference numerals refer to the like elements throughout. The embodiments are described below in order to explain the present invention by referring to the figures.

Figure 2:
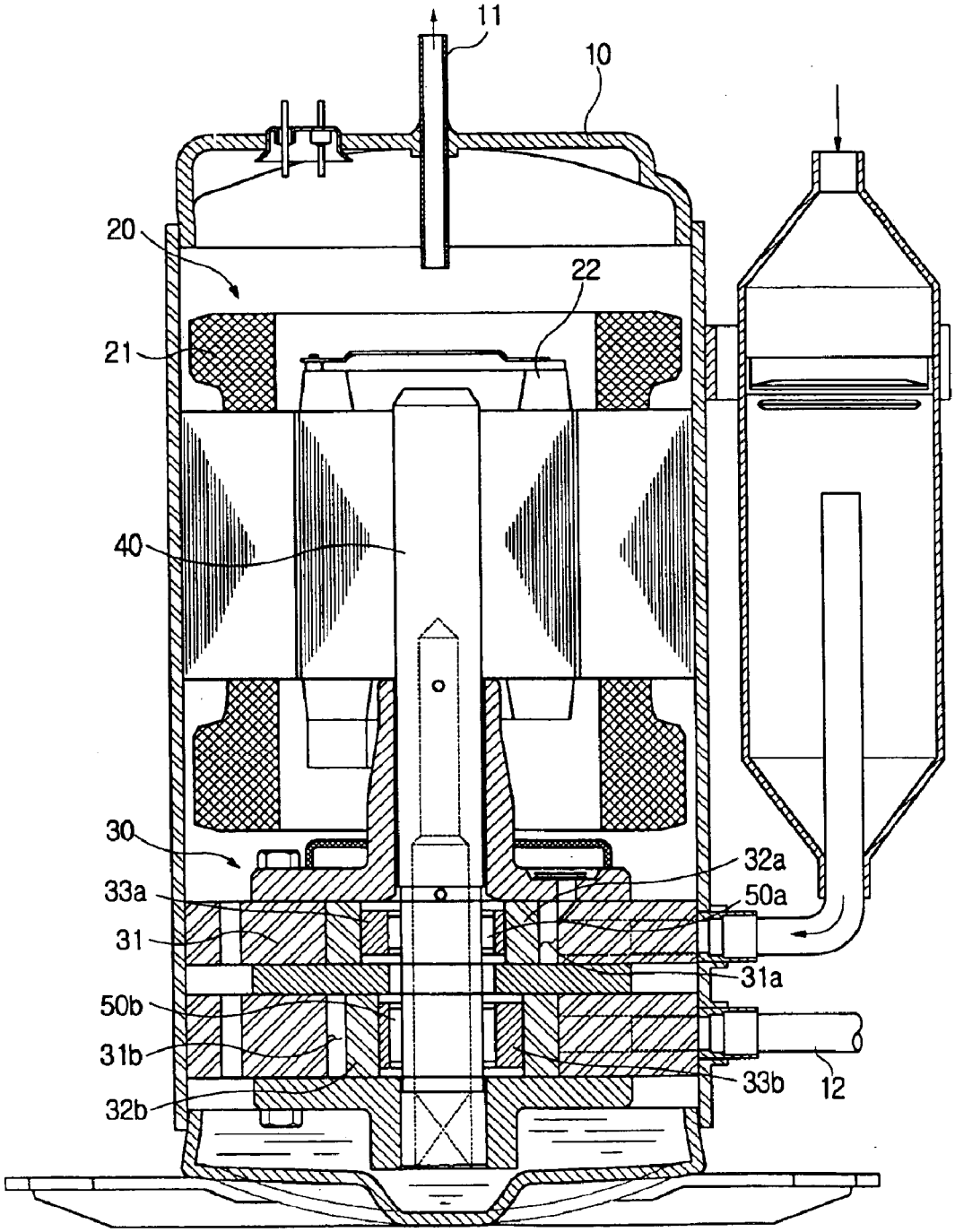
FIG. 2 is a sectional view of a rotary compressor in accordance with an embodiment of the present invention.
Figure 3:
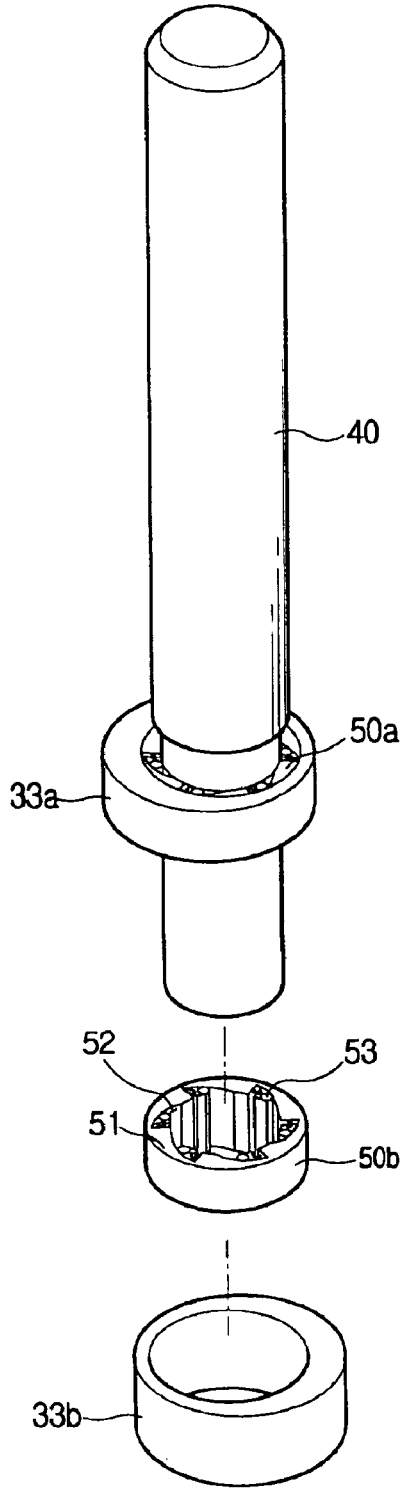
FIG. 3 is a perspective view showing a rotating shaft and an eccentric cam included in the rotary compressor in FIG. 2.

As shown in FIGS. 2 and 3, a rotary compressor according to an embodiment of the present invention comprises a hermetic casing 10, with a drive device 20 and a compressing device 30 installed in the hermetic casing 10. The drive device 20 generates a rotating force when an electric current is applied to the drive device 20. The compressing device 30 compresses refrigerant using the rotating force of the drive device 20 while intaking, compressing and discharging the refrigerant.

The hermetic casing 10 forms an appearance of the rotary compressor with a refrigerant outlet pipe 11 connected to an upper end of the hermetic casing 10 so as to discharge highly pressurized refrigerant from the rotary compressor and a refrigerant inlet pipe 12 connected to a lower end of the hermetic casing 10 so as to introduce the refrigerant into the rotary compressor.

The drive device 20 comprises a stator 21, a rotor 22 and a rotating shaft 40. The stator 21 forms an electromagnetic field when an electric current is applied to the stator 21, while the rotor 22 is rotatably and concentrically set in the stator 21. The rotating shaft 40 is a longitudinal shaft having a circular cross-section. This rotating shaft 40 is fixed to the rotor 22 at a first end of the rotating shaft 40, and passes at a second end of the rotating shaft 40 through the compressing device 30. The rotating shaft 40 is thus rotated along with the rotor 22 to transmit the rotating force of the rotor 22 to the compressing device 30.

The compressing device 30, which is operated using the rotating force of the drive device 20 transmitted thereto through the rotating shaft 40, comprises a cylinder 31 with first and second variable compressing chambers 31*a* and 31*b*. First and second rollers 32*a* and 32*b* are respectively set in the first and second variable compressing chambers 31*a* and 31*b*, and are rotated by the rotating force of the rotating shaft 40, thus compressing the refrigerant in the first and second variable compressing chambers 31*a* and 31*b*.

In the compressing device 30, the first and second variable compressing chambers 31*a* and 31*b* are axially arranged in the cylinder 31 at upper and lower positions such that sidewalls of the first and second variable compressing chambers 31*a* and 31*b* are in parallel to the rotating shaft 40. The first and second rollers 32*a* and 32*b* are, respectively, set in the first and second variable compressing chambers 31*a* and 31*b*. For ease of description, an upper variable compressing chamber 31*a* and an upper roller 32*a* are referred to as a first variable chamber 31*a* and a first roller 32*a*, respectively, and a lower variable compressing chamber 31*b* and a lower roller 32*b* are referred to as a second variable compressing chamber 31*b* and a second roller 32*b*, respectively.

The first and second rollers 32*a* and 32*b* are eccentrically installed on the rotating shaft 40 such that the first and second rollers 32*a* and 32*b* compress the refrigerant in the first and second variable compressing chambers 31*a* and 31*b* during a rotating action in the first and second variable compressing chambers 31*a* and 31*b*. To accomplish such an eccentric rotatable arrangement of the first and second rollers 32*a* and 32*b* on the rotating shaft 40, two eccentric cams 33*a* and 33*b* are, respectively, provided between the rotating shaft 40 and the first roller 32*a* and between the rotating shaft 40 and the second roller 32*b*. Due to the eccentric cams 33*a* and 33*b*, the first and second rollers 32*a* and 32*b* are, respectively, eccentrically rotated during the rotating action of the rotating shaft 40. For ease of description, the eccentric cam 33*a* provided adjacent to the first roller 32*a* is referred to as a first cam 33*a*, and the eccentric cam 33*b* provided adjacent to the second roller 32*b* is referred to as a second cam 33*b*.

One-way clutches 50*a* and 50*b* are provided between the rotating shaft 40 and the first and second eccentric cams 33*a* and 33*b*, respectively, to exclusively transmit the rotating force of the rotating shaft 40 to an associated cam 33*a* or 33*b* only when the rotating shaft 40 is rotated in either a first selected rotating direction or a second selected rotating direction. The one-way clutch 50*a*, provided between the rotating shaft 40 and the first eccentric cam 33*a*, is referred to as a first one-way clutch 50*a*, and the one-way clutch 50*b*, provided between the rotating shaft 40 and the second eccentric cam 33*b*, is referred to as a second one-way clutch 50*a*.

The first rotating direction denotes either a clockwise rotating direction or a counterclockwise rotating direction, and the second rotating direction denotes a remaining rotating direction: either clockwise or counterclockwise. Therefore, the second rotating direction is necessarily opposite the first rotating direction.

The first one-way clutch 50*a* is designed such that the first one-way clutch 50*a* exclusively transmits the rotating force of the rotating shaft 40 to the first roller 32*a* through the first eccentric cam 33*a* only when the rotating shaft 40 is rotated in the first direction. The second one-way clutch 50*b* is designed such that the second one-way clutch 50*b* exclusively transmits the rotating force of the rotating shaft 40 to the second roller 32*b* through the second eccentric cam 33*b* only when the rotating shaft 40 is rotated in the second direction.

Each of the two one-way clutches 50*a* and 50*b* is a one-way roller clutch, which comprises a cylindrical clutch body 51, with a plurality of roller-seating grooves 52 axially formed on an inner surface of the cylindrical clutch body 51. The roller-seating grooves 52 are formed on the inner surface of the clutch body 51 by cutting the inner surface at regularly spaced positions such that each groove 52 becomes gradually deeper in a direction toward the outer circumferential surface of the body 51 as shown in FIG. 3. A roller bearing 53 is seated in each of the roller-seating grooves 52.

In this case, one-way roller clutches are used as the one-way clutches 50*a* and 50*b*. However, it should be understood that the type of the one-way clutches 50*a* and 50*b* may be changed from that of the roller clutches without affecting a functioning of the present invention.

Figure 4:
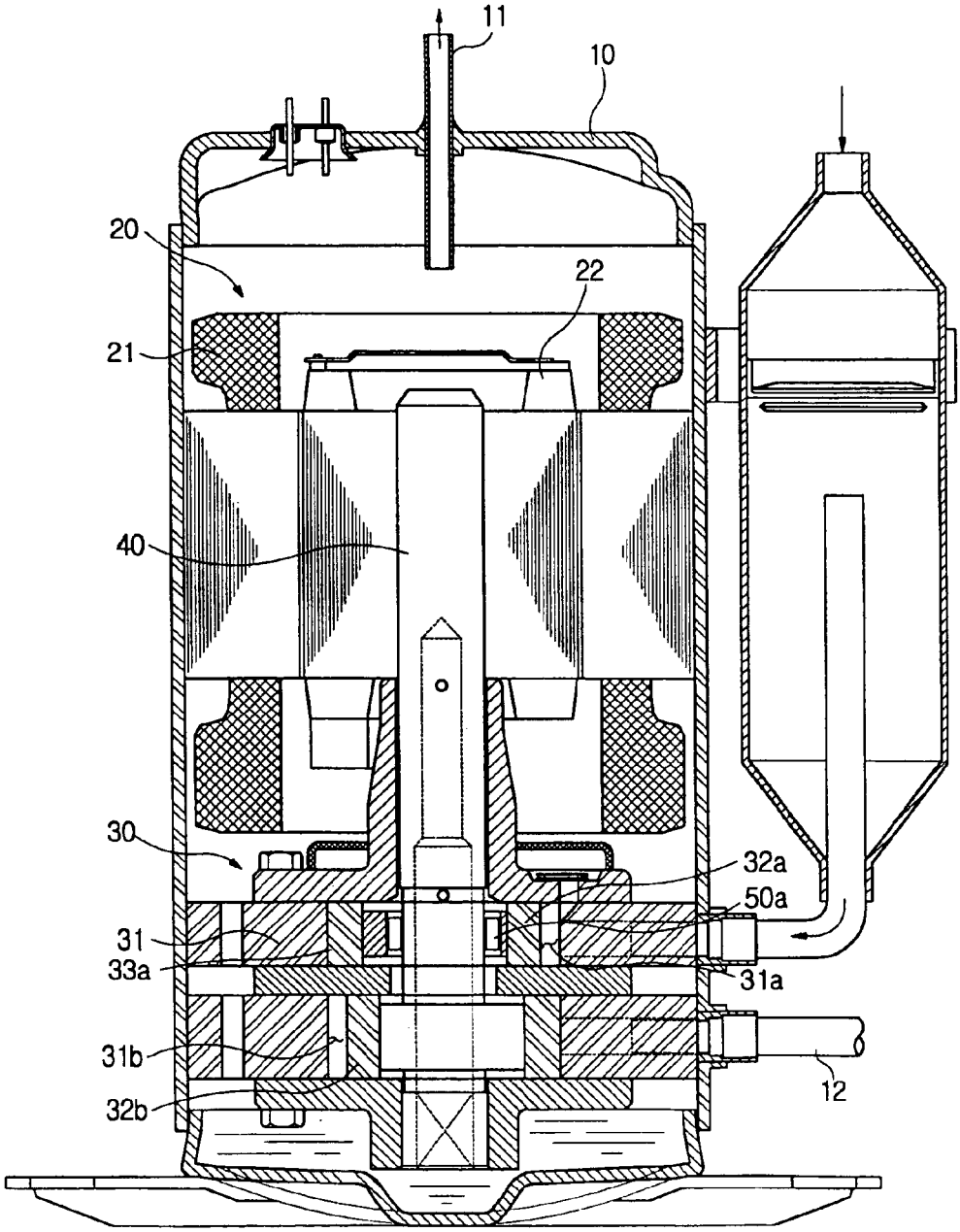
FIG. 4 is a sectional view of a rotary compressor in accordance with a second embodiment of the present invention.

Further, in this case, the compressor is designed such that two one-way clutches 50*a* and 50*b* are installed at the first and second eccentric cams 33*a* and 33*b*, respectively. However, it should be understood that the rotary compressor may be designed such that the rotary compressor has only one clutch 50*a* provided at a position associated with the first roller 32*a*, as shown in FIG. 4.

The operational of the rotary compressor of the embodiment of the present invention will be described herein below with reference to the accompanying drawings.

When the drive device 20 is turned on and the rotating shaft 40 is rotated in the first direction, the rotating force of the rotating shaft 40 is transmitted to the first roller 32*a* through the first one-way clutch 50*a* and the first eccentric cam 33*a*, so the first roller 32*a* is rotated to compress the refrigerant in the first variable compressing chamber 31*a*.

In this case, the second one-way clutch 50*b* is not in a power transmission mode since the second one-way clutch 50*b* is designed to exclusively transmit the rotating force of the rotating shaft 40 to the second roller 32*b* only when the rotating shaft 40 is rotated in the second direction. Therefore, no refrigerant is compressed in the second variable compressing chamber 31*b*, but only the first variable compressing chamber 31*a* acts as a refrigerant compressing chamber.

Alternatively, when the rotating shaft 40 is rotated in the second direction, the first one-way clutch 50*a* is not in the power transmission mode since the first one-way clutch 50*a* is designed to exclusively transmit the rotating force of the rotating shaft 40 to the first roller 32*a* only when the rotating shaft 40 is rotated in the first direction. Therefore, no refrigerant is compressed in the first variable compressing chamber 31*a*.

The rotating force of the rotating shaft 40 rotated in the second direction is transmitted to the second roller 32*b* through the second one-way clutch 50*b* and the second eccentric cam 33*b*, so that the second roller 32*b* is rotated to compress the refrigerant in the second variable compressing chamber 31*b*. That is, during the rotation of the rotating shaft 40 in the second direction, only the second variable compressing chamber 31*b* acts as the refrigerant compressing chamber.

As described above, a variable rotary compressor for refrigeration cycles is provided. In the variable rotary compressor, two rollers are installed on a rotating shaft of a drive device through one-way clutches and eccentric cams so as to be rotated by a rotating force of the drive device to compress refrigerant. During operation of the variable rotary compressor, only one of the two rollers is selectively rotated by changing a rotating direction of the rotating shaft, so a capacity of the variable rotary compressor is changeable as desired.

Although a few embodiments of the present invention have been shown and described, it will be appreciated by those skilled in the art that changes may be made in these embodiments without departing from the principles and spirit of the invention, the scope of which is defined in the appended claims and their equivalents.

What is claimed is:

1. A rotary compressor having a drive device generating a rotating force, a rotating shaft connected to said drive device at a first end thereof and rotated by the rotating force of the drive device, and a cylinder through which a second end of the rotating shaft passes, comprising:

two or more compressing chambers provided in the cylinder such that the two or more compressing chambers are sequentially arranged along an axial direction of the rotating shaft;

a plurality of rollers eccentrically installed on the rotating shaft such that the plurality of the rollers are arranged in the two or more compressing chambers, respectively; and a clutch installed on the rotating shaft and transmitting the rotating force of the rotating shaft to at least one of the plurality of rollers for varying a quantity of refrigerant discharged from the rotary compressor according to a rotating direction of the rotating shaft.

2. The rotary compressor according to claim 1, wherein the clutch is a one-way clutch transmitting the rotating force of the rotating shaft to a selected roller only when the rotating shaft is rotated in a predetermined rotating direction.

3. The rotary compressor according to claim 2, further comprising:

another one-way clutch installed on the rotating shaft to transmit the rotating force of the rotating shaft to at least another of the plurality of rollers, the other clutch transmitting the rotating force of the rotating shaft to another selected roller only when the rotating shaft is rotated in an opposite rotating direction.

4. The rotary compressor according to claim 2, wherein:

the two or more compressing chambers comprise first and second compressing chambers;

the plurality of rollers comprise first and second rollers set in the first and second compressing chambers, respectively; and the one-way clutch is installed inside at least one of the first and second rollers.

5. The rotary compressor according to claim 4, wherein the first roller is provided with the one-way clutch which exclusively transmits the rotating force of the rotating shaft to the first roller only when the rotating shaft is rotated in a first rotating direction.

6. The rotary compressor according to claim 4, wherein:

the first roller is provided with the one-way clutch which exclusively transmits the rotating force of the rotating shaft to the first roller only when the rotating shaft is rotated in a first rotating direction; and the second roller is provided with another one-way clutch which exclusively transmits the rotating force of the rotating shaft to the second roller only when the rotating shaft is rotated in a second rotating direction.

7. The rotary compressor according to claim 6, further comprising:

first and second eccentric cams provided, respectively, between the rotating shaft and the first roller and between the rotating shaft and the second roller to eccentrically rotate the first and second rollers during the rotation of the rotating shaft.

8. The rotary compressor according to claim 6, wherein each of the one-way clutches comprises:

a cylindrical clutch body;

a plurality of roller-seating grooves formed on an inner surface of the cylindrical clutch body such that each of the plurality of roller-seating grooves is gradually deeper in a direction toward an outer circumferential surface the cylindrical clutch body; and a roller bearing seated in each of the plurality of roller-seating grooves.

9. The rotary compressor according to claim 4, wherein the one-way clutch comprises:

a cylindrical clutch body;

a plurality of roller-seating grooves formed on an inner surface of the cylindrical clutch body such that each of the plurality of roller-seating grooves is gradually deeper in a direction toward an outer circumferential surface the cylindrical clutch body; and a roller bearing seated in each of the plurality of roller-seating grooves.

10. The rotary compressor according to claim 2, wherein the one-way clutch comprises:

a cylindrical clutch body;

a plurality of roller-seating grooves formed on an inner surface of the cylindrical clutch body such that each of the plurality of roller-seating grooves is gradually deeper in a direction toward an outer circumferential surface the cylindrical clutch body; and a roller bearing seated in each of the plurality of roller-seating grooves.

11. A rotary compressor having a rotating shaft rotated by a rotational force and a cylinder through which an end of the rotating shaft passes, comprising:

plural compressing chambers provided in the cylinder which are sequentially arranged in a direction extending along a length of the rotating shaft;

plural rollers eccentrically provided on the rotating shaft such that one of the plural rollers is arranged in each of the plural compressing chambers; and a clutch installed on the rotating shaft and transmitting the rotating force of the rotating shaft to at least one of the plural rollers for varying a quantity of refrigerant discharged from the rotary compressor according to a rotating direction of the rotating shaft.

12. The rotary compressor according to claim 11, further comprising:

first and second eccentric cams provided, respectively, between the rotating shaft and a first of the plural rollers and between the rotating shaft and a second of the plural rollers to eccentrically rotate each of the first and second rollers during the rotation of the rotating shaft.

13. The rotary compressor according to claim 11, wherein the clutch is a one-way clutch transmitting the rotating force of the rotating shaft to a selected roller and a compressing action of the selected roller is either provided or suppressed according to the rotating direction of the rotating shaft.

14. The rotary compressor according to claim 13, further comprising:

another one-way clutch provided on the rotating shaft to transmit the rotating force of the rotating shaft to another selected roller, the other one-way clutch transmitting the rotating force of the rotating shaft to the other selected roller and a compressing action of the other selected roller is provided, if the compressing action of the selected roller is suppressed, or a compressing action of the other selected roller is suppressed, if the compressing action of the selected roller is provided.

15. The rotary compressor according to claim 14, wherein each of the one-way clutches comprise:

a clutch body;

a plurality of roller-seating grooves formed on an inner surface of the clutch body; and a roller bearing seated in each of the plurality of roller-seating grooves.

16. The rotary compressor according to claim 15, wherein each of the plurality of roller-seating grooves is gradually deeper in a direction toward an outer circumferential surface the clutch body and the clutch body is cylindrical.

17. A rotary compressor having a rotating shaft, comprising:

plural compressing chambers; and first and second clutches to cause one or more of the plural compressing chambers to compress during only a first rotation direction of the rotating shaft, and at least one remaining compressing chamber of the plural compressing chambers to compress during only a second rotation direction of the rotating shaft, respectively, such that a compression capacity of the rotary compressor is variable according to the rotation direction of the rotating shaft.

* * * * *